United States Patent [19]

Wiebe

[11] Patent Number: 4,962,861

[45] Date of Patent: Oct. 16, 1990

[54] ARTICULATED CONNECTOR

[75] Inventor: Donald Wiebe, Sewickley, Pa.

[73] Assignee: A. Stucki Company, Pittsburgh, Pa.

[21] Appl. No.: 348,173

[22] Filed: May 1, 1989

Related U.S. Application Data

[63] Continuation-in-part of Ser. No. 177,048, Apr. 4, 1988, abandoned.

[51] Int. Cl.[5] ..... B61D 15/00

[52] U.S. Cl. ..... 213/75 R; 105/4.1

[58] Field of Search ..... 213/50, 50.5, 51, 62 R, 213/62 A, 75 R; 105/4.1, 413, 414, 420, 421

[56] References Cited

U.S. PATENT DOCUMENTS

| | | | |
|---|---|---|---|
| 3,216,370 | 11/1965 | Kulieke | 105/4 |
| 3,399,631 | 9/1968 | Weber | 105/4 |
| 3,635,168 | 1/1972 | Tack | 105/4 R |
| 3,646,604 | 2/1972 | Rodgers et al. | 105/4 R |
| 3,687,084 | 8/1972 | Charles et al. | 105/4 R |
| 3,716,146 | 2/1973 | Altherr | 213/75 R |
| 4,258,628 | 3/1981 | Altherr | 105/4 R |
| 4,336,758 | 6/1982 | Radwill | 213/75 R |
| 4,422,557 | 12/1983 | Altherr | 213/62 R |
| 4,456,133 | 6/1984 | Kaim et al. | 213/62 R |
| 4,545,304 | 10/1985 | Brodeur et al. | 105/3 |
| 4,549,666 | 10/1985 | Schmitt et al. | 213/62 A |
| 4,555,033 | 11/1985 | Miller | 213/51 |
| 4,580,686 | 4/1986 | Elliott | 213/62 A |
| 4,700,853 | 10/1987 | Kaim et al. | 213/50 |

FOREIGN PATENT DOCUMENTS

| | | | |
|---|---|---|---|
| 2169569 | 7/1986 | United Kingdom | 2.3/62 R |

*Primary Examiner*—Sherman D. Basinger
*Assistant Examiner*—Stephen P. Avila
*Attorney, Agent, or Firm*—Carothers & Carothers

[57] ABSTRACT

An articulated rail car connector for joining the adjacent ends of rail car platforms which are supported on a common truck bolster, the connector including in one preferred embodiment a pair of nested center plates which support the adjacent car platforms upon such a truck bolster and which are longitudinally slideable with respect to one another, and a drawbar pivotally connected between the adjacent car platforms to transmit longitudinally directed buff and draft loads therebetween.

17 Claims, 4 Drawing Sheets

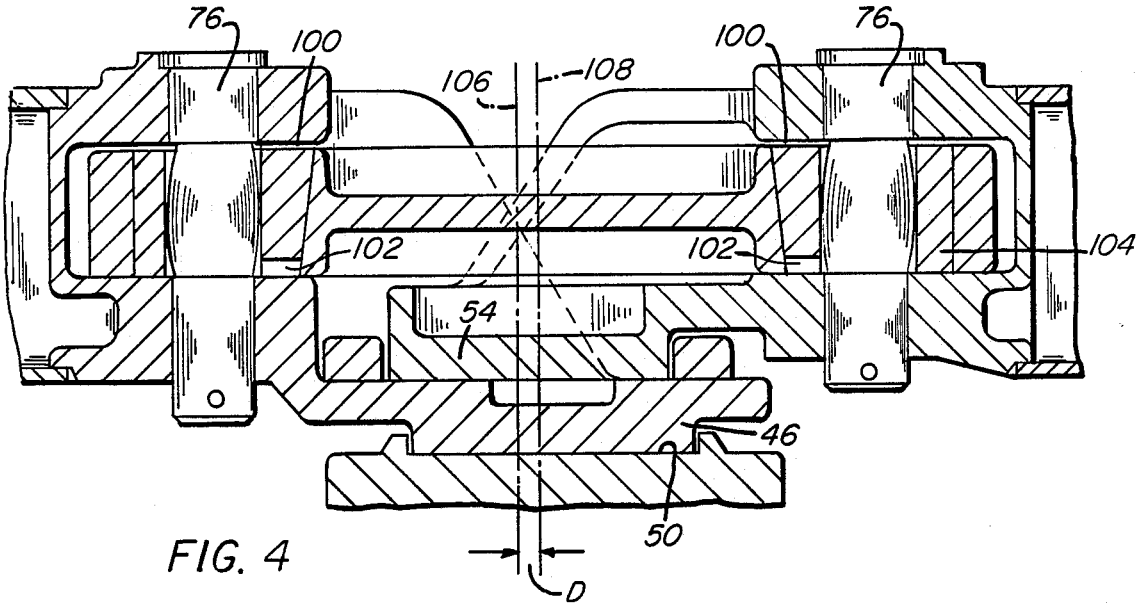
FIG. 4
FIG. 5
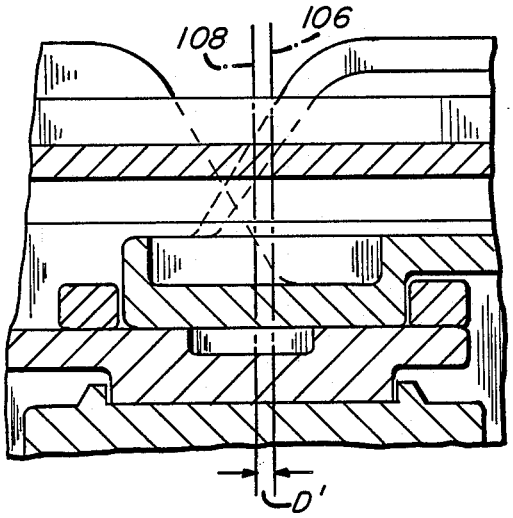
FIG. 1
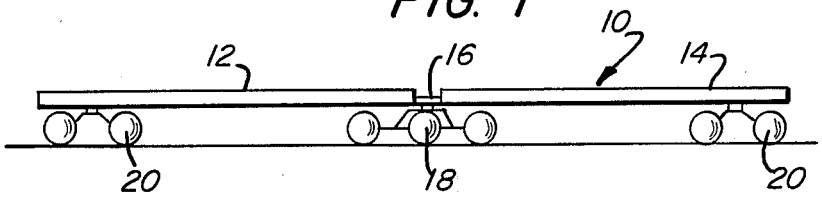

ARTICULATED CONNECTOR

This is a continuation-in-part of co-pending application Ser. No. 07/177,048 filed on Apr. 4, 1988 now abandoned.

BACKGROUND OF THE INVENTION

Articulated rail cars are well known in the railway arts and often comprise a pair of rail car platforms arranged end-to-end with the mutually adjacent ends thereof supported by a common truck bolster such as the bolster of a conventional three piece truck. In the prior art, the connection between the adjacent ends of the two car platforms, and their retention with respect to the common or center truck, has been achieved through employment of an articulated joint including complex and precisely aligned spherical bearing surfaces for achieving the rotational degrees of freedom required for such a connection. One of the two adjacent platform ends is supported on the common truck center plate surface in a conventional manner, i.e. a flat truck center plate surface supports a flat platform center plate. The other of the two adjacent platform ends is supported vertically and laterally on a spherical section that nests above the flat center plate of the first mentioned platform end. Longitudinal train action forces are transmitted between the two platforms through another set of spherical sections with the same center as the spherical sections offering vertical and horizontal support.

A wide variety of similar articulated joints or connection assemblies have been proposed in the art and purport to offer improvements in articulation, wear properties, wear take-up, and the like. Such connectors generally have provided a structure in which the connection includes a connecting pivot pin which is used to assemble the spherical segments in a manner to relate their centers of rotation to a common point for the necessary three relative rotational degrees of freedom to accommodate relative yaw, pitch and roll between the connected car bodies.

Notwithstanding their purported benefits, prior articulated connectors have exhibited certain shortcomings. For example, commercially used articulated connectors typically are costly to manufacture and difficult to assemble and disassemble. Further, critical wear can occur at the spherical bearing surfaces which transfer all the loads or forces between the ends of the interacting platforms, thus resulting in reduced vertical side bearing clearance and longitudinal slack action. Such changes result in a need for frequent side bearing clearance and slack take-up adjustment.

Vertical contacting side bearing deflections are reduced for a given car body roll angle when the relative center of longitudinal roll of the car is shorter rather than longer. For example, at one end of an articulated platform car body, a relatively flat center plate surface contact area engages the flat truck center plate. The car body thus rolls about a lateral edge of the engaged bearing surfaces, and provides a reduced radius of roll motion, with respect to the side bearings compared to the car body side bearing roll radius experienced by the opposite end of the car body which is supported on the spherical bearing section.

Prior art articulated connectors are also prone to accumulate slack and require frequent adjustment due to wear in the articulated joints in that the precision required for best performance of such prior connectors deteriorates quickly with progressive wear even if wear or slack compensation capability has been provided. That is, even where prior connectors can compensate for slack accumulation, the resultant wear nevertheless produces asymmetry with resultant binding and galling among the various cooperating spherical wear surfaces thus resulting in further accelerated rates of wear and deficiencies in connector performance.

BRIEF SUMMARY OF THE INVENTION

I have invented a novel and improved articulated rail car connector with a geometry that offers improved and simplified design, ease of manufacture and assembly, and improved performance characteristics with reduced wear potential. I have achieved these ends with an articulated connector design which, in one presently preferred embodiment, includes a longitudinal slide connection having nested male and female center plate portions carried by the respective adjacent ends of a pair of car body platforms. One centerplate portion is operable for support of the respective platform center sill and is in turn supported on the center plate of a common truck bolster. The other center plate portion is operable for support of the center sill of the other car platform and is nested within and supported by the first mentioned center plate portion. Further, the two nested center plate portions are longitudinally slideable relative to each other. An elongated draw bar extends between a pair of spaced pivot connections to bear buff and draft loads independently of the nested center plate portions. The pivot connections pivotally connect the drawbar to respective connector end portions located, for example, adjacent the respective car platform center sills.

For best results, the drawbar indicated in my articulated connector concept should be relatively slack free. Slack or free play compensation devices of various sorts are known in the art and my invention contemplates employment of any of a variety of such compensation structures, including gravity actuated wedging devices for example, to compensate for slack or free play which inevitably will develop at the drawbar end connections as longitudinal buff and draft loads are transmitted between the adjacent car platforms. In the case of the present invention, those end connections include the draw bar ends and the pivot pins by which they are pivotally retained with respect to the respective car platforms.

The above described arrangement of relatively longitudinally slideable nested center plate bearings supported on a common truck bolster provides support for the respective car platforms with the upper center plate having limited freedom to move longitudinally with respect to the lower center plate to accommodate not only progressive wear in the drawbar connections but also the relative longitudinal motion required between the two center plates when the two adjacent car platforms yaw or pitch with respect to one another.

My invention thus alleviates many of the abovementioned shortcomings of prior articulated rail car connectors, with attendant enhancements in manufacturing cost, ease of assembly and disassemably, reduced maintenance cost, improved wear properties, enhanced service performance and reliability, and improved service life.

It is therefore one object of my invention to provide a novel and improved connector for articulated rail cars.

It is a further object of my invention to provide an articulated rail car connector with nested, substantially flat center plate bearings supporting both car platforms.

Yet another object of my invention is to provide an articulated rail car connection wherein center plate or similar bearings are provided and through which a common truck bolster supports vertical and lateral loads.

Another object of my invention is to provide an articulated connector as characterized immediately above combined with a drawbar assembly for transmitting draft and buff loads independently of the common center plate interfaces.

Still another object of my invention is to provide an articulated rail car connector wherein a pair of nested center plate bearings which support respective adjacent car platform center sills are longitudinally slideable with respect to one another.

These and other objects and further advantages of my invention will be more readily understood upon consideration of the following detailed description and the accompanying drawings, in which:

FIG. 1 is a schematic side elevation of an articulated rail car including a connection between two adjacent car platforms;

FIG. 4 is a sectioned side elevation similar to FIG. 2 showing an alternative embodiment of my invention with components thereof in a new or unworn condition;

FIG. 5 is a fragmentary, sectioned side elevation showing the embodiment of FIG. 4 in a worn condition;

There is generally indicated at 10 in FIG. 1 an articulated rail car including a pair of adjacent rail car platforms 12 and 14 which are arranged end to end such that the adjacent ends thereof are joined by an articulated connector 16 and supported upon a center truck 18, for example a six-wheel truck as shown. The opposed longitudinal ends of the respective platforms 12 and 14 are supported on conventional railway trucks 20, for example, well known three piece trucks. As is well known, an articulated connector such as 16 transmits draft and buff loads between platforms 12 and 14 while permitting specified modes of freedom for relative movement therebetween, including relative pitch and yaw, and longitudinal roll.

As has been above noted, articulated cars generally are well known as are various connectors therefor. Accordingly, as all of the above enumerated elements are well known in the art, it is believed further detailed description thereof is unnecessary for an understanding of the present invention, which contemplates a novel and improved articulated connector as shown in FIGS. 2 and 3.

Figure 2:
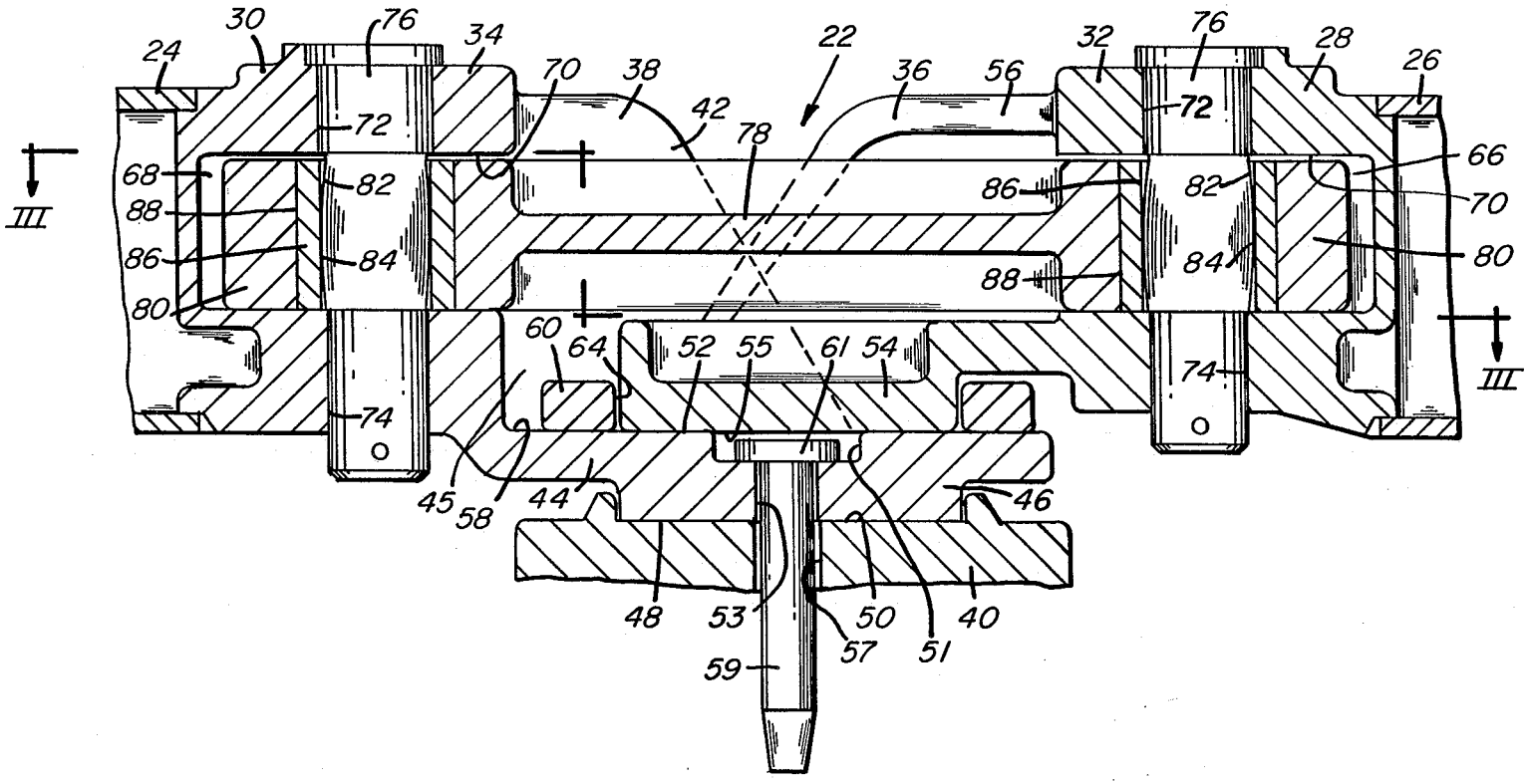
FIG. 2 is a sectioned side elevation of the articulated connection for the rail car of FIG. 1.
Figure 3:
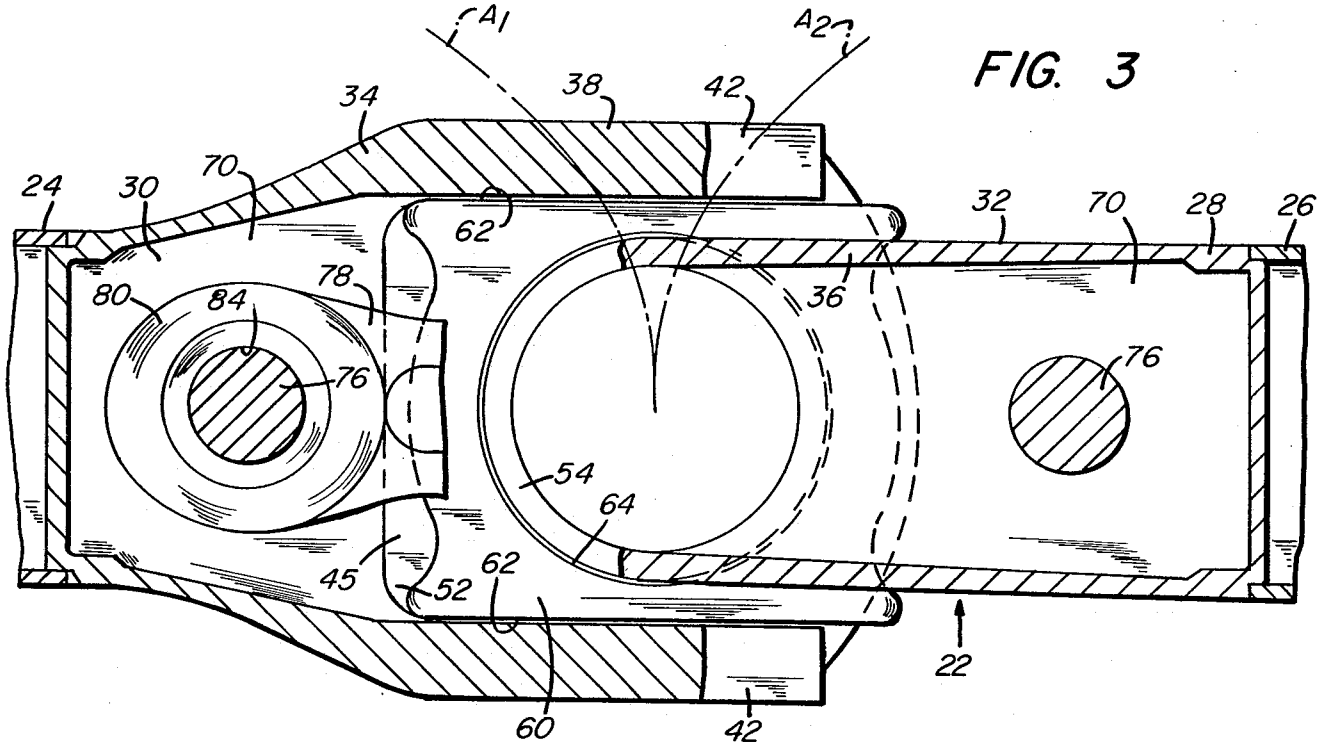
FIG. 3 is sectioned-top plan view taken on line III—III of FIG. 2.

In FIG. 2 there is generally indicated an articulated connector 22 which connects the center sills 24 and 26 of a pair of rail car platforms such as the platforms 12 and 14 (not shown in FIG. 2). Articulated connector 22 includes elongated connector portions 28 and 30 which are suitably rigidly secured to the respective center sills 26, 24, as by welding for example, so as to extend therefrom to be interfitted one within the other. Each connector portion 28 and 30 may be, for example, a unitary steel casting formed to include longitudinally extending body portions 32 and 34, respectively, which extend outwardly from the respective center sills 26 and 24 and toward each other in the assembled configuration as shown. Respective male and female connector portions 36 and 38 extend further outward from respective body portions 32 and 34, and are interfitted or nested one within the other to provide for the common support of the center sills 24 and 26 upon bearing surface 50 of a truck bolster center plate bearing 40.

More specifically, female connector portion 38 comprises a pair of rigid side wall portions 42 which extend in laterally spaced relation outwardly from body portion 34, and a base portion 44 which extends outwardly of body portion 34 intermediate the sidewalls 42 and is joined integrally therewith. A cylindrical center plate bearing portion 46 of base portion 44 is formed with a downwardly facing substantially flat bearing surface 48 which engages the cooperating bearing surface 50 of bolster center plate 40 to support connector portion 30 and sill 24 thereon. The reference to "flat" surface 48 and other bearing surfaces so characterized is to be understood as including such deviations from a flat surface configuration as specified, for example, by AAR Alternate Standard S-258-80, which specifies the geometry of a longitudinally extending bevel located at each of the laterally opposed sides of an otherwise flat centerplate bearing surface.

Base portion 44 is further formed to include an upwardly opening central recess 51 which is centered with respect to a coaxial through bore 53, both being arranged coaxially with center plate bearing surface 48. A bore 57 extends coaxially with bolster center plate bearing surface 50 for registry in coaxial alignment with bore 53 whereby a center pin 59 may be received within bores 53 and 57 with the head portion 61 thereof residing within recess 51. Center pin 59 serves to pivotally interlock female connector portion 38 with bolster 40. The depth of recess 51 preferably is greater than the axial extent of head portion 61 so that the uppermost extent of center pin 59 is below the elevation of a bearing surface upon which the male connector portion 36 is supported as follows.

The sidewalls 42 and base 44 of female connector portion 38 cooperate to form an upwardly open pocket 45 into which male connector portion 36 is received. An upwardly facing bearing surface portion 52 of base 44 supports a generally cylindrical center plate portion 54 of male connector portion 36 by engagement of a downwardly facing bearing surface portion 55 thereof. Male connector portion 36 also includes laterally spaced apart, generally parallel side wall portions 56 which extend outwardly of body portion 32 and into the upwardly open pocket 45 to provide, in conjunction with center plate portion 54 the unitary, structurally rigid male connector portion 36. Bearing surface 52 preferably extends to a width and length greater than the diameter of center plate portion 54 to accommodate therein a slide member 60 which is supported in slideable engagement on bearing surface 52 and encompasses center plate portion 54 within pocket 45.

The sidewalls 42 preferably extend longitudinally in parallel relation adjacent the lateral extremities of bearing surface 52 to define a predetermined lateral width of the bearing surface 52. Slide 60 is provided with laterally opposed, generally parallel sides 62 which are spaced apart by a dimension only slightly less than the lateral spacing between the inner surfaces of sidewall portions 42, whereby the slide 60 is received within pocket 45 in a manner to be free for longitudinal sliding therein. A preferably circular center opening 64 is formed in slide 60 to closely receive the center plate portion 54 whereby center plate portion 54 is free to rotate with respect to slide 60, and is also free to slide therewith longitudinally of pocket 45 on bearing surface 52.

It will be appreciated that the described sliding relationship between and among center plate portion 54, slide 60 and bearing surface 52 permits the male connector element 28 to slide longitudinally with respect to the female connector element 30, while remaining constrained against lateral or transverse sliding with respect to the female connector portion 30.

Of course, the structure thus far described supports only the vertical and lateral loads between the two adjacent ends of car platforms 12 and 14 through bearing support thereof on bolster center plate bearing surface 50, as provided by the nested configuration of the male and female center plate portions 54, 46. To transmit draft and buff loads between the center sills 24 and 26, each connector portion 28 and 30 is provided with a respective recess 66, 68 which forms in the respective connector portion an integral clevis 70. Axially aligned apertures 72, 74 in each connector portion 28 and 30 receive clevis pins 76 which pass through the respective clevis recesses 66 and 68. An elongated draw bar 78 extends between clevis portions 70 and includes, adjacent its longitudinally opposed ends, a pair of eye portions 80 which are disposed within clevis recesses 66, 68, respectively, and each eye portion 80 includes a bearing element 86 with a through bore 84 which receives a respective one of the pins 76. The pins 76 include radiused surface portions 82 extending longitudinally thereof and disposed for engagement with the inner periphery of respective bores 84 to thereby accommodate the necessary freedom of motion to permit relative pitch, yaw and roll between the adjacent, articulated car platforms.

Bearing elements 86 are, of course, interfitted within larger bores 88 formed in the respective draw bar eye portions 80. In addition, the assembly of bearing elements 86 with eye portions 80 may include slack or wear take-up elements of any suitable sort, as will be described hereinbelow.

It will be seen that with employment of the draw bar structure as above specified to transmit buff and draft loads through the articulated connector, the need for a complex universal type of hinge or joint is eliminated. In the connector structure above described, the center plate bearing portions carry all of the vertical weight as well as the relative lateral loads imposed by the car platforms 12 and 14 on the center truck 18. The draw bar assembly bears all of the buff and draft loads encountered in operation.

Progressive wear on the draw bar bearing elements 86 will result in changes in the geometry of the assembled connector which will also result in changes in the platform-to-platform dimension. As has been noted, wear or slack compensating structures may be provided to eliminate slack occasioned by draw bar bearing and clevis pin wear; however, such slack take-up structures generally are not capable of maintaining uniform connector geometry for the assembled connector because the geometry of a slack-compensated worn connector depends on not only the design of the slack compensating structure, but also on the connector wear patterns which develop in service. It is noted, however, that such uniformity is not required for proper performance of my novel connector. Any suitable slack compensating structure may be utilized for purposes of this invention, for example, a pair of gravity actuated wedging bushing portions 100 (FIG. 4) may be substituted for the corresponding portions of bushings 86 as shown in FIG. 2.

Such known slack compensating techniques for slackless drawbars are illustrated in U.S. Pat. Nos. 4,555,033, 4,549,666, 4,545,304, 4,700,853, 4,456,133 and 4,580,686. Slack adjusting or compensation on such drawbars may be designed to result in either a shortening or a lengthening drawbar effect. Inasmuch as slack compensation is well known from these and other prior patents, further detailed description is believed unnecessary for an understanding of the present invention.

An example of how the geometry of my novel connector can change over a given service life is illustrated in FIG. 4 wherein the connector is shown as initially configured with an off-center geometry with the central vertical axis 106 of male centerplate bearing 54 located a longitudinal dimension D from the central vertical axis or vertical center line 108 of female centerplate 46 and bolster bearing surface 50. This arrangement will provide for predictible patterns of relative migration of axes 106 and 108 with respect to each other in response to patterns of progressive wear and slack compensation design which together cause the center-to-center distance between pins 76 to gradually increase (that is, over the service life of the connector, the effective length of the drawbar gradually increases).

Accordingly, over the service life of the drawbar pivot connections to the respective connector elements, the effective length of the drawbar increases and dimension D decreases as axes 106 and 108 migrate longitudinally toward one another. Ultimately, with sufficient wear, axes 106 and 108 will longitudinally coincide, and further progressive wear will continue their migration such that axes 106 and 108 will gradually separate in the longitudinal direction, each moving in the same relative direction as during their initial approach to one another.

Of course, if the wear patterns and/or operation of the wear compensation structure tend to produce an effective shortening of the drawbar (i.e. reduction of the center-to-center distance between pins 76) axes 106 and 108 would move initially toward one another to a coincident position, and then away from one another, with their relative directions of movement opposite those above described. Accordingly, in such circumstance the initial or non-worn connector geometry would be as shown in FIG. 4 but with axis 106 to the right of axis 108, and the respective elements centered thereon positioned accordingly.

As has been above noted, my invention does not require the described center plate bearing elements to be maintained in continuous mutually centered relationship. Therefore, in service operation of my novel connector in non-centered configurations as above described occurs continually. It will be noted that such deviations from a given relative location of the centers of the two center plates also will occur in operation on curved track since lateral yaw of the articulated car platforms with respect to each other results in rotation of the male and female connector elements about pivot pins 76. Since the center-to-center distance between pins 76 is fixed at any given instant by the effective length of draw bar 78, the relative positions of axes 106 and 108 of the male and female center plate bearings 54 and 46, respectively, must of necessity vary with changes in the yaw or pitch of the adjacent platforms with respect to each other. This will be self-evident upon considering that when negotiating the curved track, the relative yaw of the articulated platforms requires each of axes 106 and 108 to swing on a circular arc centered on the axis of the respective pin 76, for example, as shown by arcs $A_1$ and $A_2$ in FIG. 3.

Thus, the axis of mutual rotation of the engaged connector center plates will always fall on arc $a_2$ and accordingly its longitudinal distance from the axis of pivot pin 76 will vary continually in service with changes in the relative yaw positions of the two connected car platforms.

Figure 6:
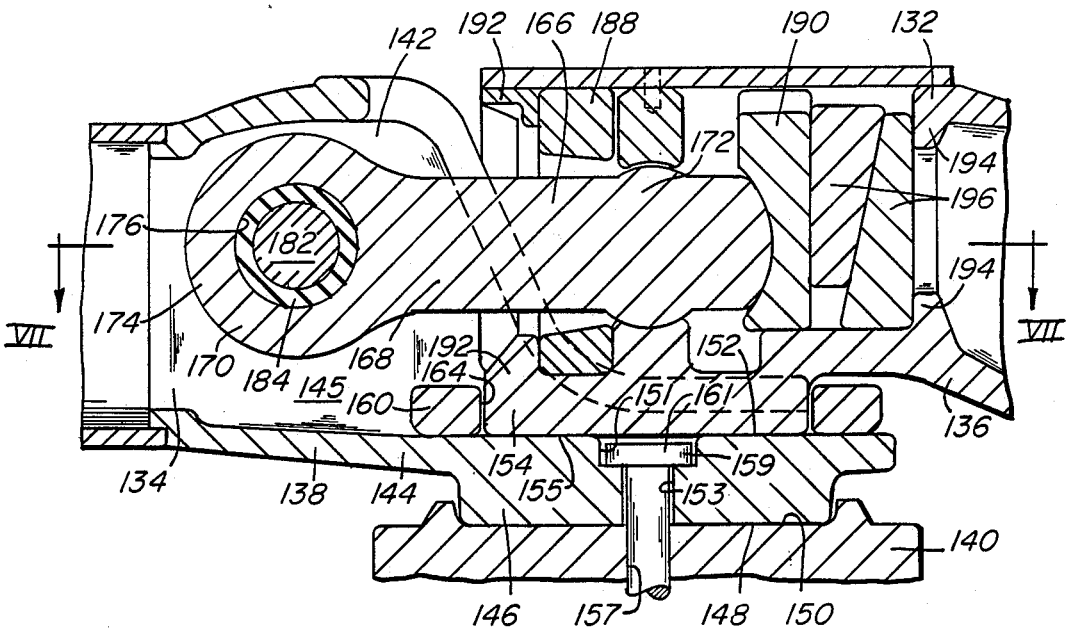
FIG. 6 is a sectioned side elevation of a further embodiment of the invention.
Figure 7:
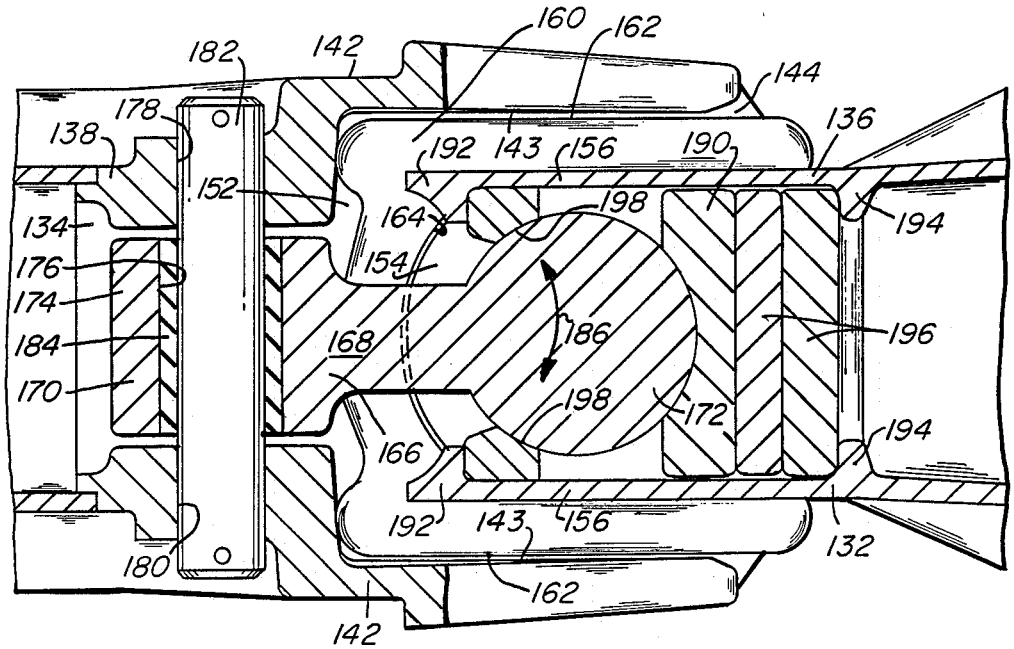
FIG. 7 is a sectioned top plan view taken on line VII—VII of FIG. 6.

An alternative embodiment of the invention as shown in FIGS. 6 and 7 includes male and female connector portions 136 and 138, respectively. Female connector portion 138 comprises a pair of rigid side wall portions 142 which extend in laterally spaced relation outwardly from a connector body portion 134, and a base portion 144 which extends outwardly of body portion 134 intermediate the sidewalls 142 and is joined integrally therewith. A preferably cylindrical center plate bearing portion 146 of base portion 144 is formed with a downwardly facing substantially flat bearing surface 148 which engages the cooperating bearing surface 150 of bolster center plate 140 to support female connector portion 138 and the corresponding car body sill thereon.

Base portion 144 is further formed to include an upwardly opening central recess 151 which is centered with respect to a coaxial through bore 153, both being arranged coaxially with center plate bearing surface 148. A bore 157 extends coaxially with bearing surface 150 in bolster centerplate 140 for registry in coaxial alignment with bore 153 whereby a center pin 159 is received within bores 153 and 157 with the head portion 161 thereof residing within recess 151. Center pin 159 serves to pivotally connect female connector portion 138 with bolster centerplate 140 so that bearing surfaces 148 and 150 are slideable on each other in relative rotary movement about the pivot axis formed by pin 159.

Male connector portion 136 includes a body portion 132 and laterally spaced apart, generally parallel side wall portions 156 which extend outwardly of body portion 132 and a center plate portion 154 disposed laterally intermediate sidewall portions 156 and joined integrally therewith. The sidewalls 142 and base 144 of female connector portion 138 cooperate to form an upwardly open pocket 145 into which the male connector portion 136 is received. An upwardly facing bearing surface portion 152 of base 144 engages a downwardly facing bearing surface portion 155 of the preferably cylindrical center plate portion 154 formed by male connector portion 136 to support male connector portion 136 with respect to female connector portion 138.

Bearing surface 152 preferably extends to a width and length greater than the corresponding width and length dimensions of center plate portion 154 to accommodate therein a slide member 160 which is supported in slideable engagement on bearing surface 152 and encompasses center plate portion 154 within pocket 145.

The female connector portion sidewalls 142 preferably extend longitudinally in spaced parallel relation adjacent the lateral extremities of bearing surface 152 such that respective inner surface portions 143 thereof form lateral boundaries for the bearing surface 152. Slide 160 is provided with laterally opposed, generally parallel sides 162 which are spaced apart by a dimension only slightly less than the lateral spacing between the corresponding inner surfaces 143, whereby the slide 160 is freely longitudinally moveable within pocket 145. An at least partially circular center opening 164 is formed in slide 160 to receive the male center plate portion 154 whereby center plate portion 154 is freely rotatable with respect to slide 160, and is also free to slide therewith longitudinally with respect to female connector portion 134 on bearing surface 152.

As with other embodiments described above, the described sliding relationship between and among center plate portion 154, slide 160 and bearing surface 152 permits the mutual center of relative rotation between these elements to move longitudinally on the connector centerline while remaining constrained against lateral or transverse movement with respect thereto.

The FIG. 6 and 7 embodiment includes a drawbar structure to bear buff and draft loads independent of the described centerplate bearing engagement. Accordingly, a drawbar assembly 166 comprises an elongated body member 168 which extends between a pivot connection portion 170 adjacent one longitudinal end thereof and a spherical bearing portion 172 adjacent the opposed longitudinal end thereof. Pivot connection end portion 170 comprises an eye portion 174 having a through opening 176 which is located intermediate and in coaxial alignment with a pair of coaxially disposed through bores 178, 180 formed in female connector body portion 134.

A pivot pin 182 extends within bores 176, 178 and 180 to pivotally connect drawbar 168 to female connector portion 138. In addition, the diameter of bore 176 is sufficiently larger than the diameter of pin 182 to receive therebetween a cylindrical bushing 184 which is formed preferably of resilient, deformable elastomeric material such as polyurethane. Bushing 184 provides a degree of freedom between drawbar 168 and pin 182 to accommodate limited relative rotation of drawbar 168 in directions generally parallel to the axial extent of pin 182, for example as indicated by arrows 186 in FIG. 7. It will be noted that pivotal movement of drawbar 168 about pin 182 in either the lateral or the vertical direction causes the vertical axis of rotation of bearings 152 and 155 to move longitudinally with respect to the axis of pin 182.

Such movements may occur as a result of relative rock or roll motions between the connected cars, as above described. For example, when the connected cars rock or roll relative to each other, the engaged centerplate bearing surfaces 152 and 155 separate as the male connector portion rocks upwardly on one or the other of its lateral edges with respect to the female connector portion. This results in both vertical lifting, and lateral translation of the spherical end 172 of drawbar 168. Such lateral translation is accommodated at the opposed end of the drawbar 168 by resilient deformation of bushing 184 as pin 182 is rigidly fixed within bores 178, 180.

To further accomodate relative rock and roll motions as well as relative pitch and yaw between the connected car bodies or platforms, the spherical bearing end portion 172 of drawbar 168 is retained with respect to male connector portion 136 by spherical bearing elements 188 and 190. Bearing element 188 is retained intermediate spherical bearing portion 172 and draft lugs 192 located adjacent the outermost end of male connector sidewall portions 156. Bearing element 190 is a spherical buff bearing which is retained in spaced relationship with respect to buff lugs 194 by any suitable slack take up or compensation apparatus, for example a gravity wedge assembly 196 such as above described.

Spherical bearing element 188 preferably is a continuous circular structure, preferably a ring, having one or more spherical bearing surface portions 198 (FIG. 7). In a preferred form, the ring 188 is captively retained by drawbar 168 as the inner diameter of ring 188 is smaller than that necessary to pass over either end of drawbar 168. The described bearing ring 188 and its captive retention with respect to a drawbar constitute a structure conceived by another and included herein for purposes of compliance with best mode disclosure requirements of the patent statute.

It will be seen that, as with the embodiments described hereinabove, the embodiment of FIGS. 6 and 7 also is operative to carry buff and draft loads by means of a drawbar independently of the vertical loads borne by the described centerplate bearings. Complex spherical hinge joints with mutual centers for all relative motions thus are not required, and indeed the geometry of the drawbar assembly may vary with respect to the geometry of the centerplate bearing assembly just as in the other above described embodiments without any adverse consequence.

It will be further apparent from the above description of the FIGS. 6 and 7 embodiments that for purposes of this invention it is not necessary for the centerplate bearing portions to be located between the locations at which buff and draft loads are transmitted between the drawbar 168 and the respective connected car bodies.

According to the description hereinabove, I have invented a novel and improved connector for articulated rail cars which offers the benefits of simplified design and assembly, ease and economy of maintenance, economy of manufacture, and reliability in operation, among other attributes. Of course I have contemplated a variety of alternative and modified embodiments and such would also certainly occur to those versed in the art, once apprised of my invention. Accordingly, it is my intent that the invention be construed as broadly as permitted by the scope of the claims appended hereto.

I claim:

1. In a rail car connecting apparatus that is operable to transmit buff and draft loads between a pair of adjacent rail car platform ends that are supported for relative movement with respect to each other and for movement thereof along a railway track, a connector assembly, comprising:

a first connector portion adapted to be affixed to one of such a pair of platform ends;

a second connector portion adapted to be affixed to the other of such a pair of platform ends;

said first and second connector portions including mutually engageable bearing means which are cooperable to provide support for one of said first and second connector portions by the other and to permit relative pivotal movement of said first and second connector portions with respect to each other about given axes of rotation;

an elongated draft appliance extending longitudinally of said first and second connector portions;

said first and second connector portions including respective longitudinally spaced connection means connecting the respective said connector portions to said draft appliance; and said connection means being disposed with respect to said mutually engageable bearing means such that at least some of said given axes of rotation move longitudinally with respect to at least one of said connection means in response to at least some modes of such relative pivotal movement between said first and second connector portions.

2. The connector assembly as claimed in claim 1 wherein said mutually engageable bearing means are cooperable to accommodate relative longitudinal movement between said first and second connector portions.

3. The connector assembly as claimed in claim 2 additionally including means for controlling the range of relative longitudinal movement between said first and second connector portions.

4. The connector assembly as claimed in claim 3 wherein said means for controlling the range of relative longitudinal movement includes said connection means.

5. The connector assembly as claimed in claim 4 wherein said mutually engageable bearing means, when mutually engaged, are located longitudinally intermediate the respective said longitudinally spaced connection means of said first and second connector portions.

6. The connector assembly as claimed in claim 5 wherein said mutually engagebale bearing means includes first and second center plate bearing portions of said first and second connector portions, respectively.

7. The connector assembly as claimed in claim 6 wherein said first and second center plate bearing portions, when mutually engaged, are vertically nested as upper and lower center plate bearing portions.

8. The connector assembly as claimed in claim 7 wherein the one of said first and second connector portions having said lower center plate bearing portion includes a third center plate bearing portion which is adapted to engage a railway truck bolster center plate.

9. The connector assembly as claimed in claim 8 additionally including means for limiting relative lateral movement between said first and second center plate bearing portions.

10. The connector assembly as claimed in claim 9 wherein said means for limiting lateral movement includes a slide means which encompasses said upper center plate bearing portion and is longitudinally slideable on said lower center plate bearing portion.

11. The connector assembly as claimed in claim 1 wherein one of said first and second connector portions includes another bearing means which is adapted to engage a mobile support to provide support of said first and second connector portions with respect to such a railway track.

12. In a rail car connecting apparatus that includes a draft applicance which is operable to transmit buff and draft loads between the adjacent ends of a pair of rail car platforms which are supported for movement along a railway track, a connector assembly comprising:

a first connector portion adapted to be affixed with respect to one of such rail car platforms and having a first bearing portion which is adapted to engage a center plate of a railway truck bolster for support of said first connector portion with respect to such a railway track;

a second connector portion adapted to be affixed with respect to the other of such rail car platforms;

said first and second connector portions including respective cooperable center plate bearing portions which are mutually engageable for support of said second connector portion with respect to said first connector portion and for relative rotation of said first and second connector portions about a first pivot axis;

said first and second connector portions including respective pivot connection means for pivotal connection of said first and second connector portions, respectively, to such a draft applicance for pivotal movement thereof with respect to such a draft appliance about respective, longitudinally spaced second and third pivot axes; and said center plate bearing portions being disposed with respect to the respective said pivot connection means such that said first pivot axis moves longitudinally with respect to at least one of said second and third pivot axes in response to pivotal movement of said connector portions with respect to such a draft applicance.

13. The connector assembly as claimed in claim 12 wherein said first pivot axis is longitudinally moveable with respect to said second and third pivot axes while the longitudinal spacing between said second and third pivot axes remains constant.

14. In a connector apparatus for supporting the adjacent ends of a pair of rail car platforms with respect to a common truck, the combination comprising:

a first rigid connector means affixed to one of such rail car platforms and extending outwardly therefrom;

a second rigid connector means affixed to the other of such rail car platforms and extending outwardly therefrom into longitudinally adjacent relation with said first rigid connector means;

said first and second rigid connector means including respective first and second bearing portions which are mutually engageable and at least one of said first and second rigid connector means further including another bearing portion which is cooperable with such a truck in a manner that said another bearing portion and said first and second bearing portions provide gravitational support of said first and second rigid connector means with respect to such a truck;

said first and second rigid connector means including respective draft connection portions which are spaced longitudinally apart when said first and second bearing portions are mutually engaged; and a draft means cooperable with said draft connection portions, respectively, to transmit buff and draft loads therebetween independently of said first and second bearing portions.

15. The combination as set forth in claim 14 wherein said draft means includes an elongated draft element extending longitudinally of said first and second rigid connector means.

16. The combination as set forth in claim 15 wherein said draft element includes a pair of longitudinally spaced portions which are cooperable with said draft connection portions, respectively.

17. The combination as set forth in claim 16 additionally including means connecting said longitudinally spaced portions in buff and draft load transmitting engagement to said draft connection portions, respectively.

* * * * *